United States Patent [19]

Kaneko et al.

[11] Patent Number: 4,550,638

[45] Date of Patent: Nov. 5, 1985

[54] PORTABLE KEYBOARD-TYPE MUSICAL INSTRUMENT

[75] Inventors: Kenkichi Kaneko; Takeshi Hattori; Kensaku Hakamata; Satoru Hayashi; Takayuki Goshima; Masakazu Matsumoto, all of Hamamatsu, Japan

[73] Assignee: Kabushiki Kaisha Kawai Gakki Seisakusho, Shizuoka, Japan

[21] Appl. No.: 496,433

[22] Filed: May 20, 1983

[30] Foreign Application Priority Data

May 31, 1982 [JP] Japan ..... 57-80368

[51] Int. Cl.[4] ..... G10C 3/12

[52] U.S. Cl. ..... 84/431; 84/177; 84/186 R; 84/DIG. 3; 150/52 R

[58] Field of Search ..... 84/177, 186 R, 190, 84/352, 354, DIG. 3, 176, 421; 150/52 R

[56] References Cited

U.S. PATENT DOCUMENTS 2,505,805 5/1950 Stein ..... 84/177

4,376,402 3/1983 Helpinstill, II ..... 84/431 X

FOREIGN PATENT DOCUMENTS 99590 6/1932 Japan .

45-14135 6/1970 Japan .

52-87224 6/1977 Japan .

OTHER PUBLICATIONS

"Fachblatt Test Jahrbuch 80/81", JV-Journal Verlag GmbH, pp. 120–123.

*Primary Examiner*—Benjamin R. Fuller

*Attorney, Agent, or Firm*—Abelman, Frayne Rezac & Schwab

[57] ABSTRACT

A portable keyboard-type musical instrument includes detachable end support frames which can be attached to the musical instrument in either an extended supporting position or a retracted storage position, a support for the keyboard of the instrument being rigidly supported by members which are in turn rigidly attached to the frame of the musical instrument.

6 Claims, 12 Drawing Figures

PORTABLE KEYBOARD-TYPE MUSICAL INSTRUMENT

FIELD OF THE INVENTION

This invention relates to a portable, keyboard-type musical instrument, such as a portable upright piano.

The invention finds equal applicaton in other forms of portable, keyboard-type musical instruments, examples of such instruments being upright harpsichords, cymbalons, chamber organs, and electronic music synthesizers, in which it is required that the main body of the instrument be unitary and self-contained for ease of transportation, and that the keyboard be extendable for performance on the instrument and retractable for it to be stored within the body of the instrument during the transportation thereof.

THE PRIOR ART

Portable, keyboard-type musical instruments are known in which the main body of the instrument has end frames attached to each end thereof, the respective end frames incorporating legs. the end frames are attachable to the instrument in a retracted position in which the legs are located above the bottom surface of the instrument and permit the instrument to be moved on a dolly or on wheels or castors fixed to the bottom surface of the main body, or in an extended position in which the legs extend downwardly beyond the bottom surface of the instrument, and provide for the support of the instrument at an appropriate height for performance thereon.

Portable, keyboard-type musical instruments also are known in which the keyboard is hinged to or pivotally mounted on the main body off the instrument in such a manner that the keyboard can be stored within a casing of the main body during transportion of the instrument, and then be swung upwardly to a horizontal position at an appropriate height for performance on the instrument. In this known construction, separate legs are attached to the keyboard after it has been moved to the horizontal positon, the legs acting to maintain and position the keyboard in correct relationship with the main body of the musical instrument during performance thereon.

The positional relationship of a keyboard to the main body of the musical instrument is critical, particularly in those cases in which the keys actuate a mechanical action of the instrument, such as the camming and hammer action of a piano. In the event that the musical instrument is placed on other than a flat surface when readied for performance, there is a decided probability that the keys of the instrument will not be in their exact required position relative to the mechanical action of the instrument, with a consequence that performance on the instrument is adversely affected.

THE INVENTIVE CONCEPT

The present invention overcomes the problems of the known construction by eliminating the separate supporting legs for the keyboard and by providing a rigid support for the keyboard when in its extended position, the rigid support being positively positionally related to the main body of the instrument.

As the keyboard is supported directly by the main body of the instrument and positively positionally related thereto when in its extended position, the keyboard is predictably correctly positioned relative to the mechanical action of the instrument, even in the event that the musical instrument is placed on an uneven surface.

In order to improve the stability of the musical instrument during performance thereon, the legs of the respective end frames preferably are hinged to mounting members attached to the ends of the main body of the instrument, and are held in splayed angular relationship by struts which interconnect the legs with the main body of the instrument.

DESCRIPTION OF THE DRAWINGS

The invention will now be described with reference to the accompanying drawings, and in which.

Figure 1:
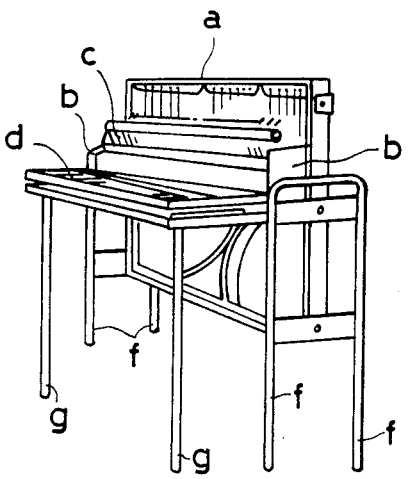
FIG.1 PRIOR ART
FIG. 1 is a perspective view of a known form of portable musical instrument when readied for performance thereon, and which is identified as being "prior art".
Figure 2:
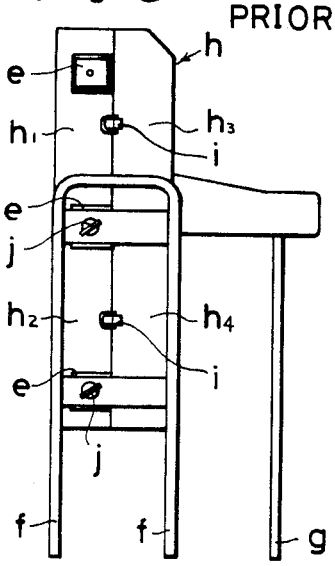
FIG.2 PRIOR ART
FIG. 2 is an end view of the portable musical instrument illustrated in FIG. 1, and also is identified as being "prior art"
Figure 5:
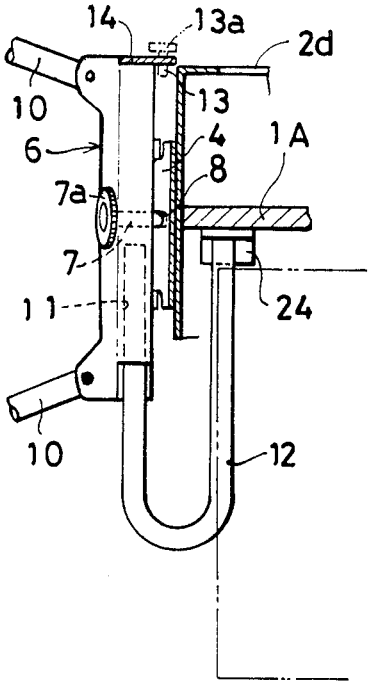
FIG. 5 is a cross-section taken on the line V—V of FIG. 4.
Figure 6:
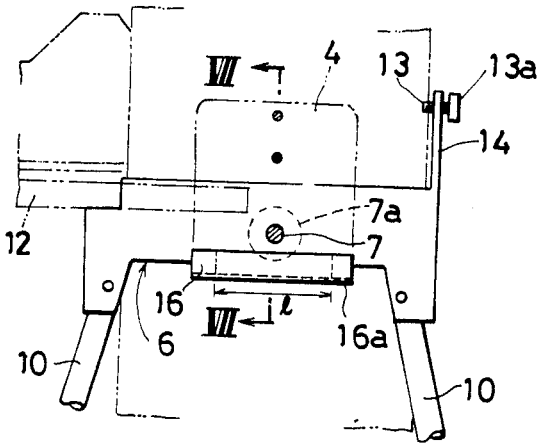
FIG. 6 is a side elevation of the supporting bracket illustrated in FIG. 5, when removed from the main body of the instrument, the positional relationship of the main body of the instrument and of the keyboard being illustrated in chain-dotted lines.

Referring firstly to FIGS. 1 and 2, a known form of portable musical instrument is shown and illustrated in a position readied for performance on the musical instrument. The musical instrument illustrated is in the form of a portable piano having a frame or harp a carrying the strings, bridge and sounding board, and to which are attached brackets b which rigidly support the mechanical action and hammers c directly from the frame. Independent therefrom, and hinged to the frame a is a keyboard d, which is shown in its extended position, and which can be swung downwardly for it to lie parallel to the main frame a.

At each end of the main frame a are mounting brackets e, by means of which end frames f providing legs for the musical instrument can be attached to the main frame a either in an extended supporting position, or in a retracted position for transportation of the musical instrument.

The keyboard d is supported at its forward edge by auxiliary supporting legs g, which are removably attached to the keyboard after it has been swung upwardly to its extended position.

For transportion purposes, split casing portions h1, h2, h3 and h4 are provided, the casing portions having been omitted in FIG. 1 for the sake of clarity. The casing portions conveniently are secured to each other by tongue and toggle type fasteners i, the casing portions h3 and h4 providing an aperture through which the keyboard d extends when in its raised position. Conveniently, the casing portions h1 and h2 are permanently attached to the frame a and are apertured at their ends to provide access to the mounting brackets e.

To ready the musical instrument for transportation, the fasteners i are released, the casing portions h3 and h4 are removed, the ancilliary supporting legs g are removed from the keyboard d, and the keyboard is then swung downwardly into parallel relation with the main frame a. Conveniently, the casing portions h3 and h4 are then replaced and fastened to the casing portions h1 and h2, subsequent to which the winged screws j are removed at one end of the instrument in order to permit removal of the end frame. The end frame is then repositioned and attached to the uppermost pair of the mounting brackets e by means of the winged screws j, at which time the legs f lie above the lower surface of the main frame or body a. The end frame at the opposite end of the musical instrument is then repositioned in an identical manner, thus readying the musical instrument for transportation on a dolly or castors (not shown).

While the construction so far described is admirable for its intended purpose in instances in which the musical instrument is supported on a flat and substantially planar surface, in the event that the surface is uneven and other than planar, then, the legs g will not predictably orient the keyboard d in correct relationship with the mechanical action c, and faulty and erratic operation of the mechanical action will occur during performance on the instrument. The same problem will occur in other types of keyboard operated musical instruments in which the keys operate a mechanical action or operate electrical switches.

DESCRIPTION OF THE PREFERRED EMBODIMENTS

Referring now to FIGS. 3 through 8, there is illustrated a preferred embodiment of the present invention, which avoids the problems discussed above. In these figures, the portable musical instrument is indicated generally at 1, and includes a main frame or harp 1A, a mechanically operated hammer action 1B, and a keyboard 1C. The casing of the instrument is indicated generally at 2, the casing including casing portions 2A, 2B, 2C, 2D, which are appropriately apertured at 2*a*, 2*b*, and 2*c* to expose mounting brackets carried by the main frame. The respective pairs of casing portions are detachably secured to each other by tongue and toggle type fasteners 3, or any other convenient form of fastener.

The main mounting bracket for the end frames is provided by a mounting plate 4, which is rigidly secured to the main frame, and which conveniently incorporates a carrying handle 5. The mounting plate 4 is exposed through the aperture 2*c*, and includes a lower downwardly and outwardly extending tongue portion which terminates in a tongue having a length l.

The mounting plate 4 is employed for detachably securing a mounting member 6, a screw 7 having a knurled head 7*a* being employed for this purpose. The screw passes through the mounting member 6 and is received within a threaded aperture 8 of the mounting plate 4. The mounting member 6 alternatively is attachable to the mounting plate 4, or it is attachable to a mounting bracket 9 secured to an upper portion of the main frame. The mounting bracket 9 has a threaded aperture 9*a* complementary to the threaded aperture 8, and which receives the mounting screw 7.

Figure 3:
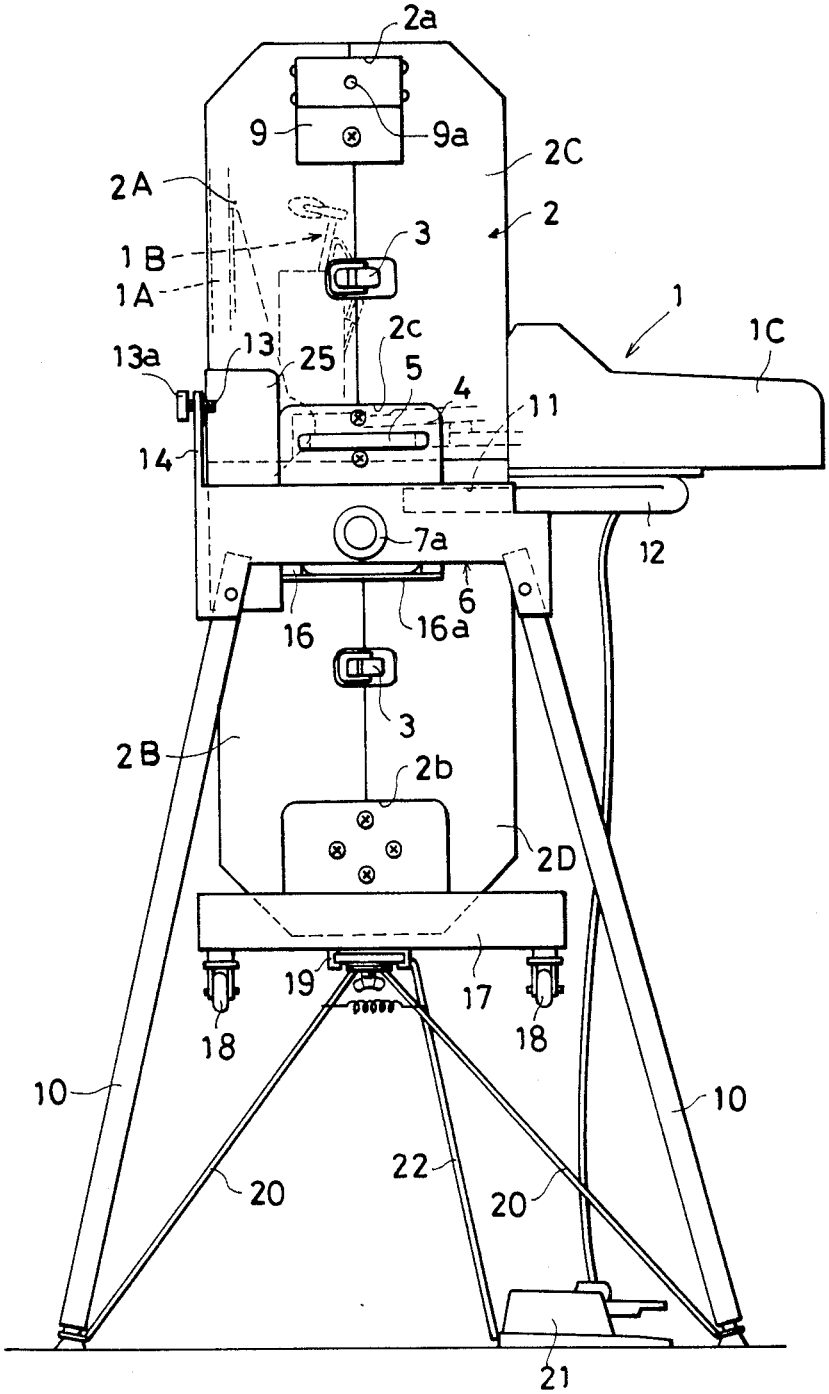
FIG. 3 is an end view of a portable musical instrument according to the present invention when in a position readied for performance thereon.
Figure 4:
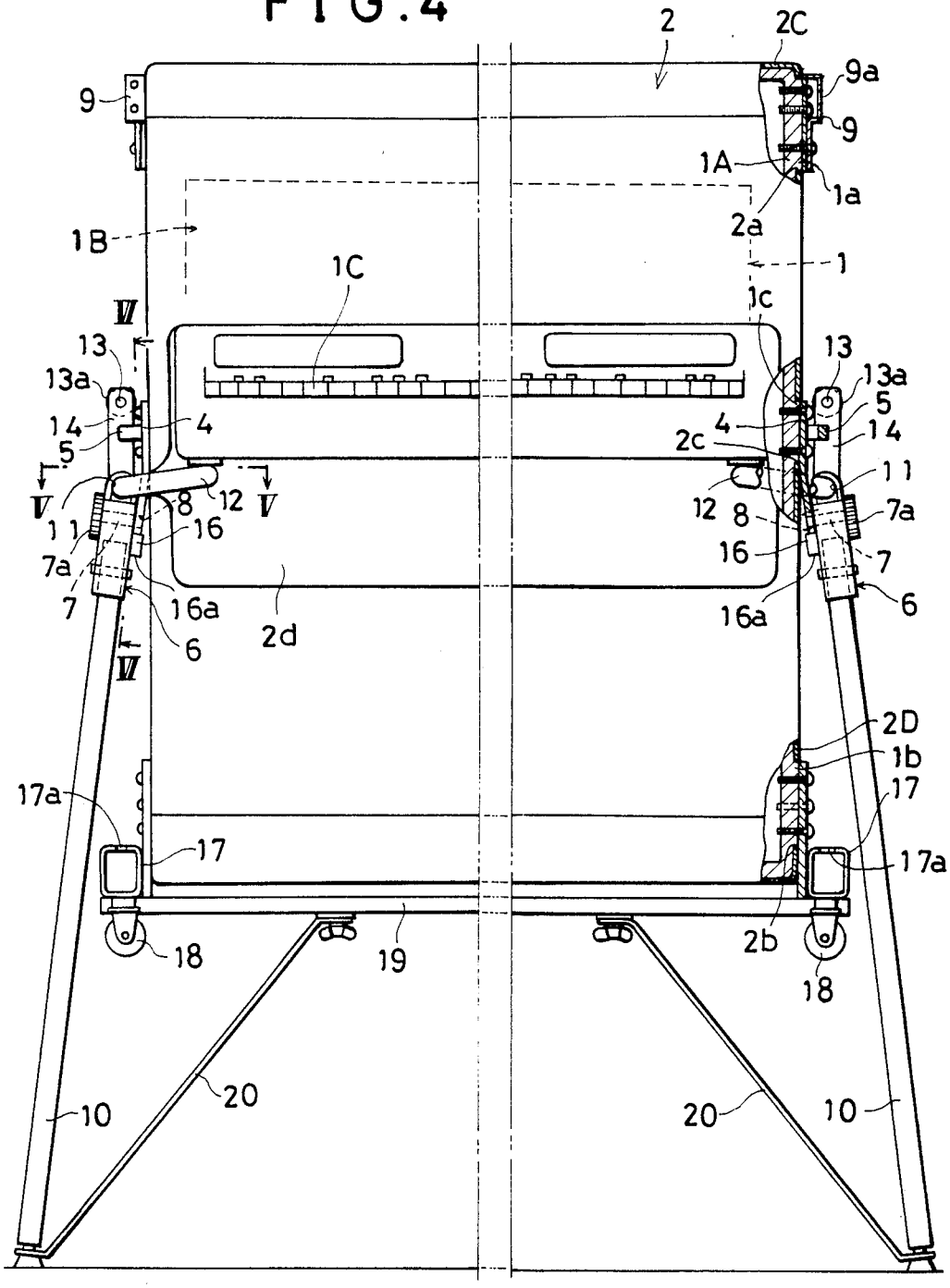
FIG. 4 is a front view of the portable musical instrument of FIG. 3.
Figure 7:
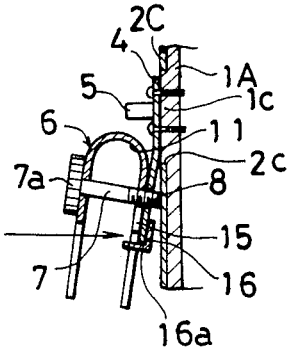
FIG. 7 is a cross-section taken on the line VII—VII of FIG. 6.
Figure 8:
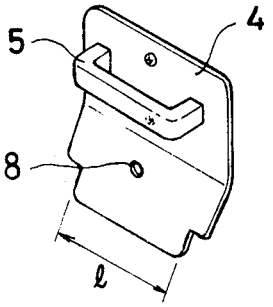
FIG. 8 is a perspective view of a support bracket illustrated in FIG. 7.
Figure 9:
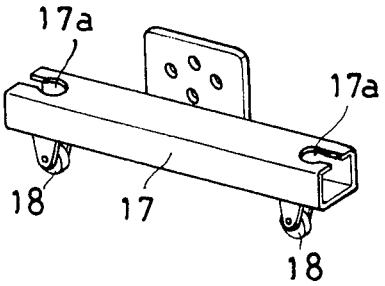
FIGS. 9 and 10 illustrate alternative forms of support castors for the main body.
Figure 10:
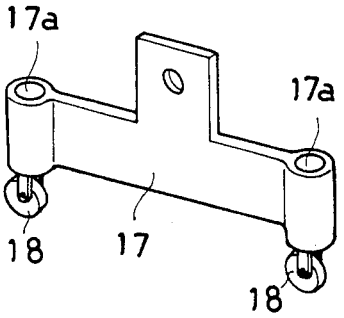
Figure 11:
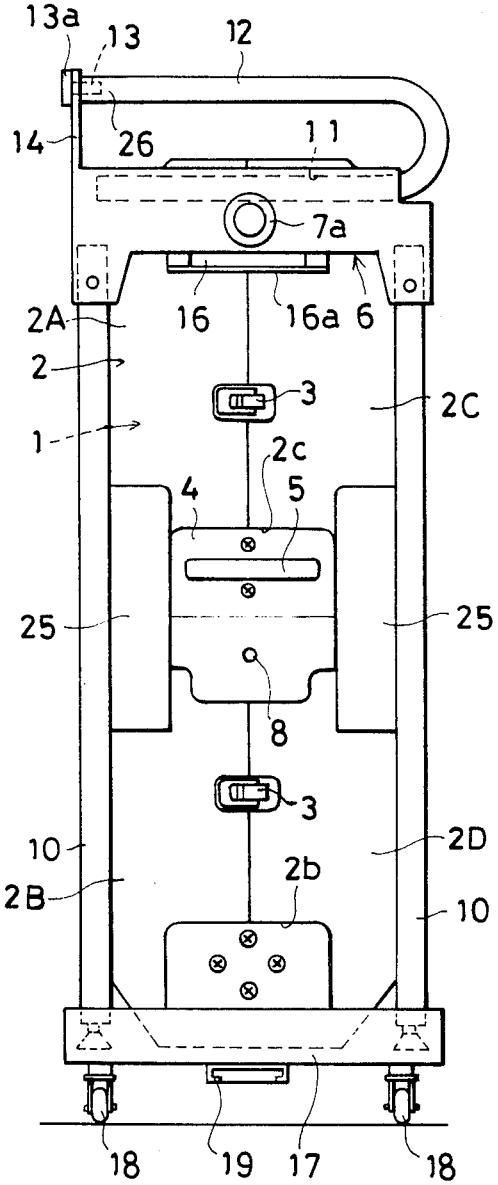
FIGS. 11 and 12 are respectively an end elevation and a fragmentary front elevation of the portable musical instrument showing the supporting legs and other integers of the end frames when in a stored position for transportation of the portable musical instrument.

The mounting member 6 extends transversely of the end of the musical instrument, and at its opposite ends has legs 10 pivotally mounted thereto, the legs 10 being movable from the splayed condition shown in FIG. 3 to a parallel position for storage as shown in FIG. 11. The mounting member 6 also provides a C-shaped clamp in which one arm 11 of a U-shaped support member is received and clamped upon tightening down of the screw 7. The other arm 12 of the U-shaped support extends underneath the keyboard 1C, and is positionally located as later described.

Extending from a rear portion of the mounting member 6 is an up-standing arm 14, which, at its upper end carries a locking screw 13 having a knurled head 13*a*.

At its lower edge, the mounting member 6 is provided with a slot 15 of a length sufficient to receive the tongue at the lower edge of the mounting plate 4, the slot being provided in a flange 16, the slotting of the flange providing a bridge 16*a* by means of which the tongue of the mounting plate 4 is held captive.

To secure the mounting member 6 to the mounting plate 4, the end of the musical instrument is raised by means of the handle 5, and the tongue of the mounting plate 4 is inserted into the slot 15 of the mounting member 6. This positions the screw 7 correctly for reception in the threaded aperture 8. The mounting screw 7 is then partially tightened down to provide stability to the assembly. The keyboard 1C is then raised to its extended position, and the arm 11 of the U-shaped support is inserted into the mounting member 6 with the other arm 12 of the U-shaped supported properly positioned. The mounting screw 7 is then fully tightened down, and the legs 10 are pivoted into their extended splayed position as shown in FIG. 3.

The lower portion of the musical instrument is provided with a bottom support bracket 17 which extends through the apertures 2*b* in the casing members 2B and 2D. The bottom support bracket carries castors 18 and a bar 19 interconnecting the respective bottom support brackets 17. Struts 20 attached to the ends of the legs 10 are then secured to the bar 19 by a wing nut or winged screw, thus providing a stable support for one end of the musical instrument. This procedure is then repeated at the opposite end of the musical instrument to support the musical instrument at its correct height for use in performance, and, a pedal 21 carried by a support strut 22 is then attached to the cross bar 19.

In this condition, the keyboard 1C, which can pivot upwardly to permit ready insertion of the U-shaped supports 11 and 12 is firmed-down on top of the arms 12 of the U-shaped supports, the arms 12 at their ends being positioned on and located by L-shaped brackets 24 carried by the main frame 1A. In this manner, an entirely stable support for the keyboard is provided, which is entirely isolated from and independent of the support legs 10.

As the keyboard 1C is held positioned by the mounting member 6 rigidly attached to the main frame 1A, and as the support 24 for the arm 12 of the U-shaped support is fixed on the main frame 1A, the keyboard 1C on all occasions predictably is moved into its correct positional relationship with respect to the mechanically operated hammer action 1B. The casing portions 2C and 2D, which have been removed to permit movement of the keyboard 1C to its extended position can then be re-affixed by the fasteners 3 with the keyboard 1C extending through a longitudinal aperture provided by the casing portions.

Conveniently, panel members 25 are provided at opposite ends of the musical instrument, the panels 25 being affixed to the main frame 1A and being exposed through apertures formed in the casing portions 2A.

The reverse procedure is followed in readying the musical instrument for transportion. Firstly, the casing portions 2C and 2D are removed, the mounting screw 7 is loosened off to free the clamping engagement on the arm 11 of the U-shaped support, and the U-shaped support is withdrawn. The keyboard can then be rotated downwardly for it to lie parallel to the bottom portion of the main frame 1A, subsequent to which the casing portions 2C and 2D are reaffixed to the instrument. One end of the instrument is then raised by means of the handle 5, and the mounting member 6 then completely detached from the instrument, the same procedure being followed on the opposite end of the instrument.

Figure 12:
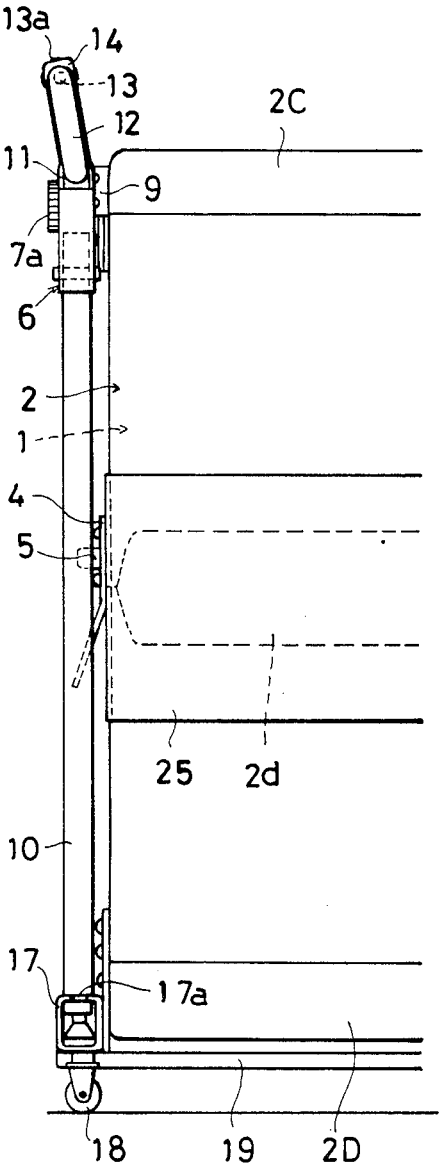
Figure 3:
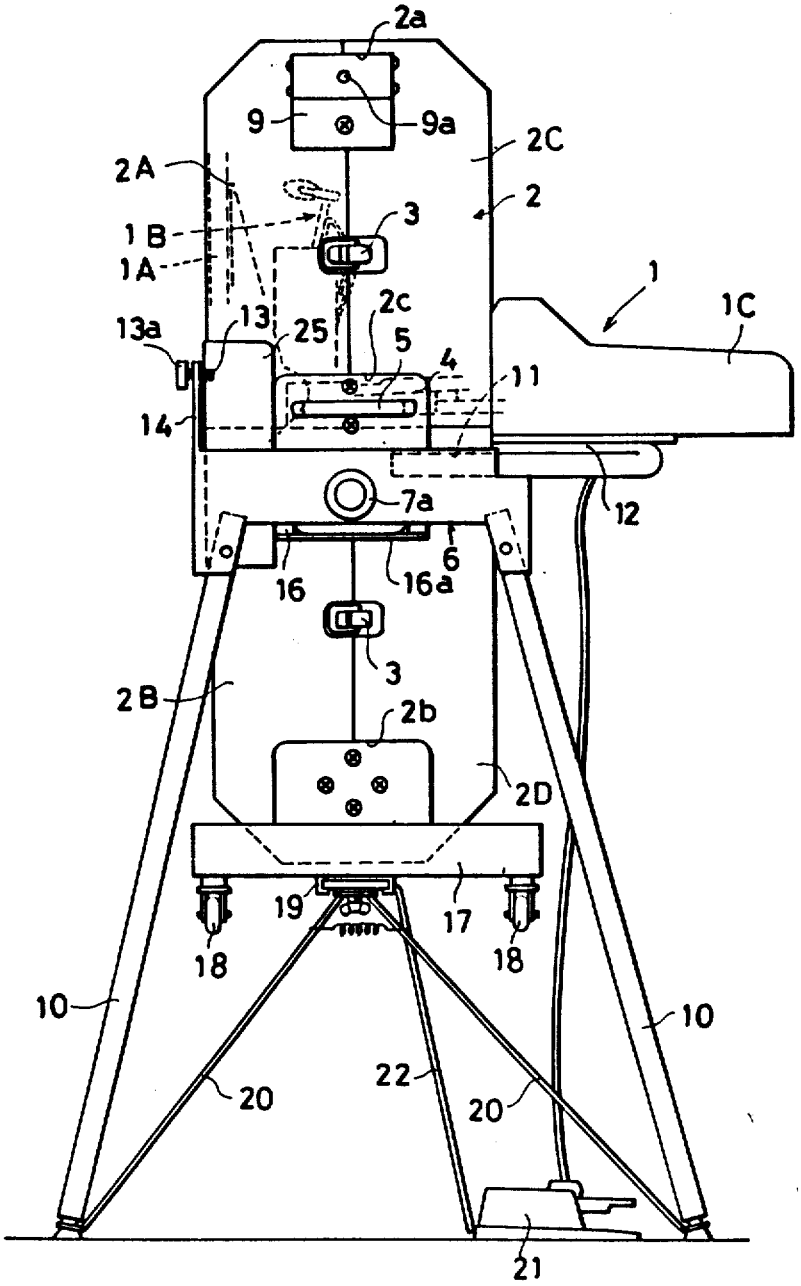
Figure 4:
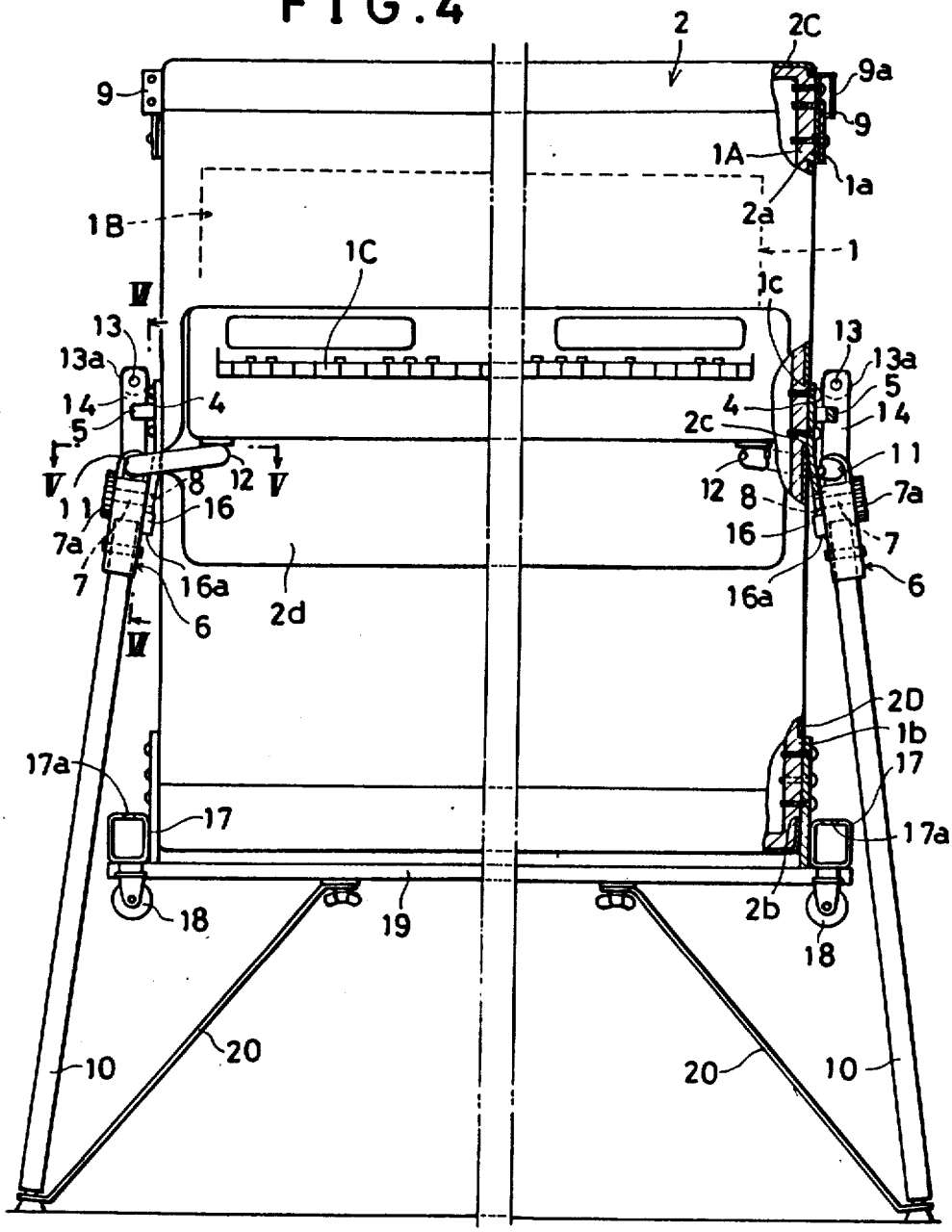
Figure 3:
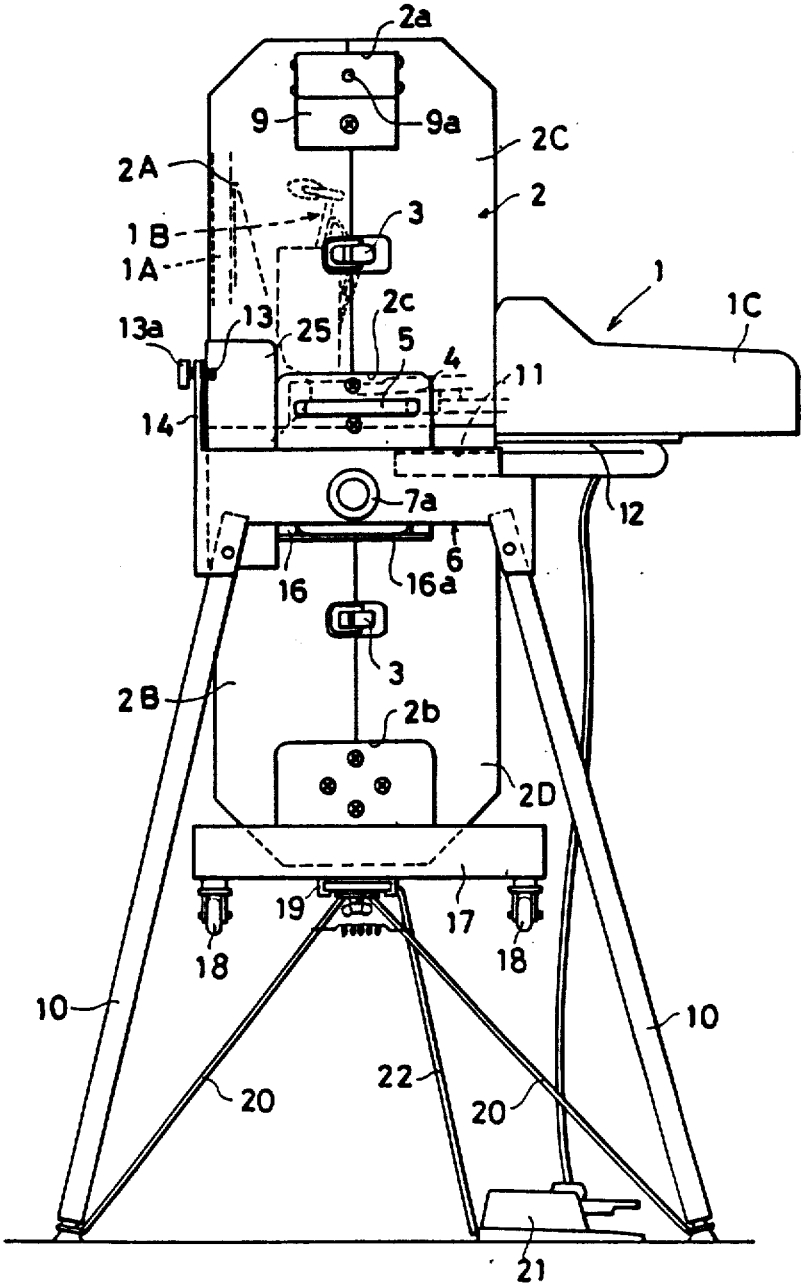
Figure 4:
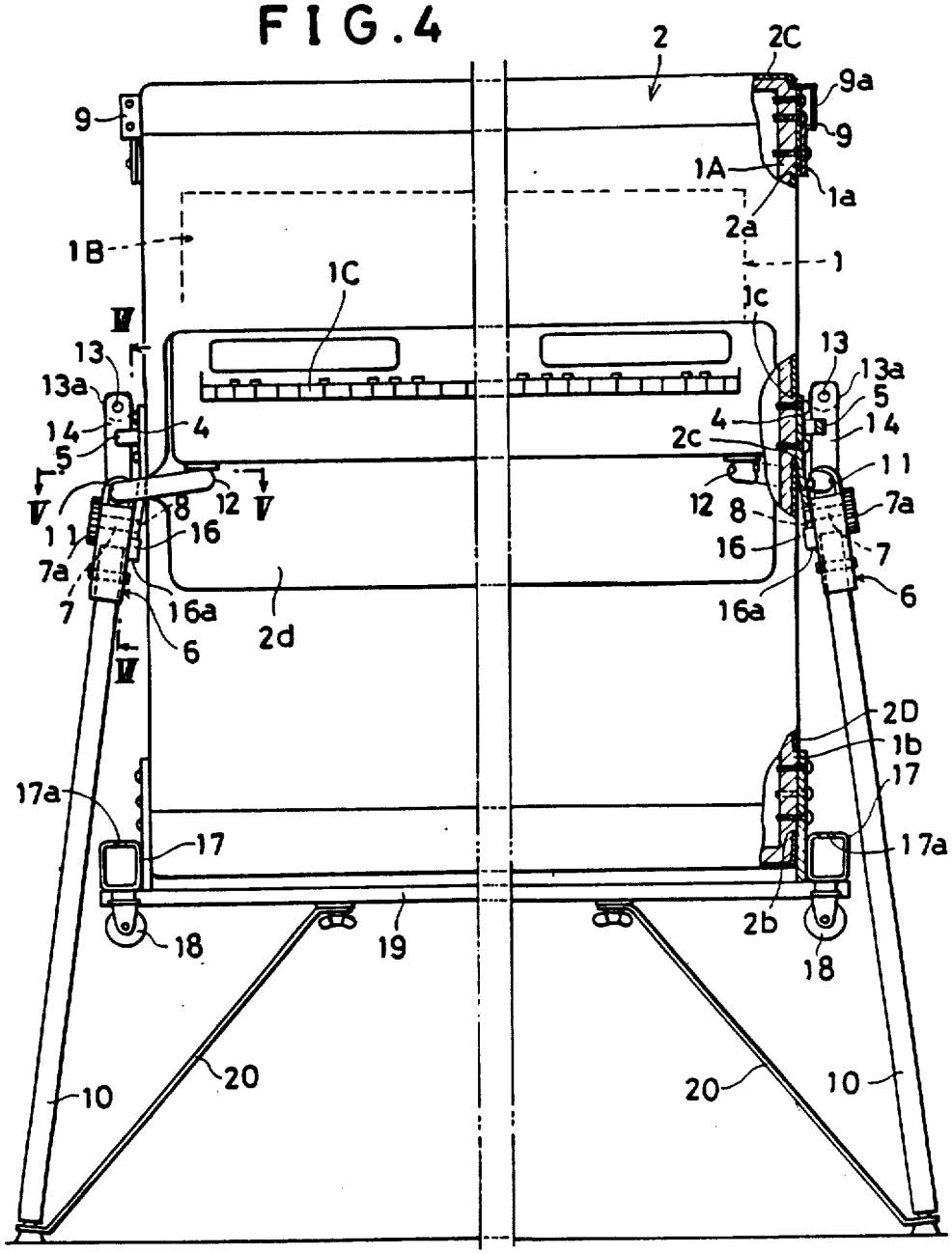
Figure 7:
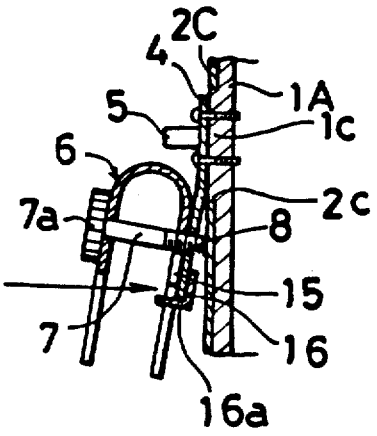
Figure 12:
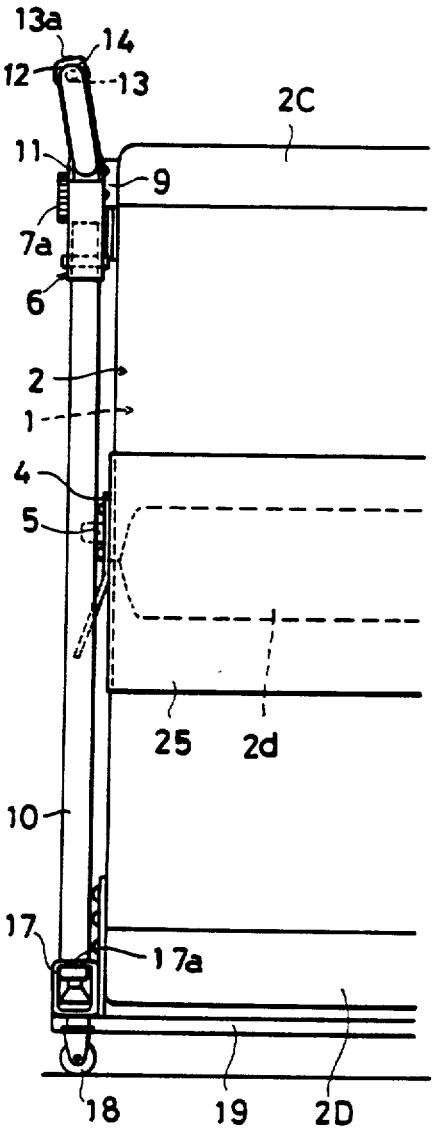

Subsequent to removal of the end frames from the instrument, and as shown in FIGS. 11 and 12, the lower end of the legs 10 are inserted into apertures 17*a* in the bottom support brackets 17 and the end frame members 6 are secured to upper mounting brackets 9 by threading the mounting screws 7 into the threaded apertures 9*a*. Prior to complete tightening of the mounting screws 7, the U-shaped supports are reinserted into the mounting members 6. The arm 12 is then secured by the locking screw 13, subsequent to which the mounting screw 7 is fully tightened down. In this manner, rigid end frames are provided for the musical instrument which provide handles assisting in the manual movement of the instrument.

The pedal 21 and its support 22, which are removed prior to the removal of the end frames, as are the struts 20, readily can be secured and stored within the casing portion 2C, the keyboard 1C at that time being stored within the casing portion 2D.

It will be understood that the embodiment described above is a preferred embodiment according to the present invention, and, that various modifications may be made therein without departing from the scope of the appended claims.

We claim:

1. In a portable, keyboard-type musical instrument having a main frame, a keyboard pivotally connected to the main frame and movable between an outwardly extended operative position and a retracted storage position, and frame members providing legs and which are attachable to the musical instrument in an extended supporting position or in a retracted storage position, the improvement comprising:

a mounting plate at each end of said frame member and rigidly secured thereto, each said mounting plate including means for positioning and locating a mounting member;

each said mounting member carrying supporting legs for said musical instrument, and each including an elongate inverted U-shaped clamp for the reception of a keyboard support member, each said mounting member being securable to the associated said mounting plate by screw means extending through said clamp of said mounting member;

each said keyboard support member comprising an elongate U-shaped tubular member providing two arms and having one arm positioned within said U-shaped clamp and clamped therein upon appropriate actuation of said screw means;

means on said frame member for supporting an internally threaded other arm of each said keyboard support member in a keyboard supporting position; and, an upstanding bracket on each said mounting member having other screw means carried thereby;

said keyboard support members, on relaxation of said U-shaped clamps, being movable axially to withdraw them from engagement with said support means on said main frame, then being swingable about the axis of said one arm, then being movable axially towards the associated upstanding bracket of the associated mounting member to move said internally threaded other arm into registration with said other screw means of said associated upstanding bracket, and then being rigidly securable to the associated mounting member by threading the associated said other screw means into said internally threaded other arm of said keyboard support member, and, by then retightening the screw means associated with the associated U-shaped clamp.

2. The musical instrument of claim 1, in which said keyboard support members are comprised by L-shaped brackets fast with said main frame.

3. The musical instrument of claim 1, including mounting plates attached to said main frame at the opposite ends thereof, each said plate having a tongue for positioning within a slot within the associated mounting member, said tongue being operative to locate said mounting member against rotational movement relative to said mounting plate.

4. The musical instrument of claim 1, in which said supporting legs are hingedly connected to said mounting members and are movable between a splayed support position and a substantially parallel storage position.

5. The musical instrument of claim 1, including bottom brackets rigidly attached to said main frame and providing support for the ends of said legs when said legs are in a stored position.

6. The musical instrument of claim 5, further including struts attachable to said legs and to said bottom brackets.

* * * * *

UNITED STATES PATENT AND TRADEMARK OFFICE

CERTIFICATE OF CORRECTION

PATENT NO. : 4,550,638 Page 1 of 4

DATED : November 5, 1985

INVENTOR(S) : Kenkichi Kaneko et al.

It is certified that error appears in the above-identified patent and that said Letters Patent is hereby corrected as shown below:

The sheets of drawing consisting of figures 3, 4, 7 and 12 should be deleted to appear as per attached sheets.

UNITED STATES PATENT AND TRADEMARK OFFICE

CERTIFICATE OF CORRECTION

PATENT NO. : 4,550,638 Page 4 of 4

DATED : November 5, 1985

INVENTOR(S) : Kenkichi Kaneko et al.

It is certified that error appears in the above-identified patent and that said Letters Patent is hereby corrected as shown below:

FIG. 7

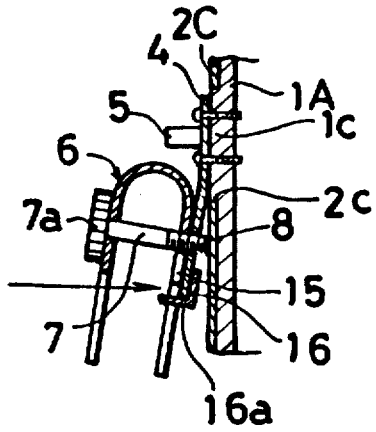

Signed and Sealed this

Fourth Day of November, 1986

[SEAL]

*Attest:*

DONALD J. QUIGG

*Attesting Officer*

*Commissioner of Patents and Trademarks*

UNITED STATES PATENT AND TRADEMARK OFFICE
CERTIFICATE OF CORRECTION

PATENT NO. : 4,550,638 Page 1 of 4

DATED : November 5, 1985

INVENTOR(S) : Kenkichi Kaneko et al.

It is certified that error appears in the above-identified patent and that said Letters Patent is hereby corrected as shown below:

The sheets of drawing consisting of figures 3, 4, 7 and 12 should be deleted to appear as per attached sheets.

This certificate to supersede Certificate of Correction issued Nov. 4, 1986.

Signed and Sealed this

Sixteenth Day of December, 1986

*Attest:*

DONALD J. QUIGG

*Attesting Officer* *Commissioner of Patents and Trademarks*